US011302152B2

(12) United States Patent
Hall

(10) Patent No.: US 11,302,152 B2
(45) Date of Patent: Apr. 12, 2022

(54) ENTERTAINMENT SYSTEM FOR CASINO WAGERING

(71) Applicant: SG Gaming, Inc., Las Vegas, NV (US)

(72) Inventor: Geoff Hall, West Midlands (GB)

(73) Assignee: SG Gaming, Inc., Las Vegas, NV (US)

( * ) Notice: Subject to any disclaimer, the term of this patent is extended or adjusted under 35 U.S.C. 154(b) by 113 days.

(21) Appl. No.: 16/776,747

(22) Filed: Jan. 30, 2020

(65) Prior Publication Data

US 2020/0327776 A1 Oct. 15, 2020

Related U.S. Application Data

(60) Provisional application No. 62/833,740, filed on Apr. 14, 2019.

(51) Int. Cl.

| | |
|---|---|
| ***A63F 1/00*** | (2006.01) |
| ***A63F 3/00*** | (2006.01) |
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3293* (2013.01); *A63F 1/00* (2013.01); *G07F 17/322* (2013.01); *G07F 17/3248* (2013.01); *G07F 17/3258* (2013.01); *A63F 2001/003* (2013.01)

(58) Field of Classification Search

CPC ..... G07F 17/3248; G07F 17/3258; G07F 17/3293; A63F 1/00; A63F 2001/003; A63F 3/00157

See application file for complete search history.

(56) References Cited

U.S. PATENT DOCUMENTS

| | | | | |
|---|---|---|---|---|
| 5,364,105 | A | 11/1994 | Jones | |
| 5,636,843 | A * | 6/1997 | Roberts | A63F 1/18 273/292 |
| 6,062,564 | A * | 5/2000 | Terminel | A63F 3/00157 273/292 |
| 6,158,741 | A * | 12/2000 | Koelling | A63F 3/00157 273/292 |
| 6,481,718 | B2 | 11/2002 | Koelling | |
| 7,066,466 | B1 | 6/2006 | Stavinsky et al. | |
| 9,811,980 | B1 | 11/2017 | Kowalchuk et al. | |
| 2005/0218598 | A1 * | 10/2005 | Parsadaian | A63F 1/00 273/292 |

(Continued)

*Primary Examiner* — Milap Shah

(57) ABSTRACT

Systems and methods for implementing a blackjack game, the methods including providing a physical blackjack table and at least one physical deck of cards, providing a paytable with a plurality of numbers of cards of a specific suit and a respective payout, receiving a main wager and a side wager from a player using physical chips, dealing a reference hand from the at least one physical deck of cards, determining a number of cards in the reference hand that are of the specific suit, providing predetermined side wager resolution rules, and resolving the side wager using the predetermined side wager resolution rules. The predetermined side wager resolution rules include paying a payout on the side wager using the paytable if the number of cards is at least a predetermined number and collecting the side wager if the number of cards is not at least the predetermined number.

19 Claims, 5 Drawing Sheets

(56) References Cited

U.S. PATENT DOCUMENTS

| | | | | |
|---|---|---|---|---|
| 2007/0052175 | A1* | 3/2007 | McGurk | A63F 3/00157 273/292 |
| 2007/0132183 | A1 | 6/2007 | Moses | |
| 2008/0258389 | A1* | 10/2008 | Friedman | G07F 17/32 273/292 |
| 2009/0267301 | A1 | 10/2009 | Au-Yeung | |
| 2010/0062820 | A1 | 3/2010 | Yoshizawa | |
| 2010/0213672 | A1* | 8/2010 | Chamberlain | G07F 17/3293 273/292 |
| 2010/0227673 | A1 | 9/2010 | Dargue | |
| 2010/0252997 | A1* | 10/2010 | Walker | G07F 17/32 273/292 |
| 2010/0270741 | A1 | 10/2010 | Petty | |
| 2012/0135790 | A1 | 5/2012 | Powell et al. | |
| 2012/0280453 | A1 | 11/2012 | Moss | |
| 2015/0279165 | A1 | 10/2015 | Kock | |
| 2015/0371501 | A1* | 12/2015 | Jackson | G07F 17/326 463/13 |
| 2016/0136512 | A1* | 5/2016 | Pertgen | A63F 3/00157 463/13 |
| 2017/0278354 | A1* | 9/2017 | Bird | G07F 17/3211 |
| 2017/0323530 | A1* | 11/2017 | Hemberger | G07F 17/3293 |
| 2019/0035225 | A1* | 1/2019 | Kemper | G07F 17/3293 |

* cited by examiner

ENTERTAINMENT SYSTEM FOR CASINO WAGERING

RELATED APPLICATION

This patent application claims the priority benefit of U.S. Provisional Patent Application Ser. No. 62/833,740 filed Apr. 14, 2019, the contents of which is incorporated herein by reference in it entirety.

BACKGROUND OF THE INVENTION

Field of the Invention

The present general inventive concept is directed to a method, apparatus, and computer readable storage medium directed to a wagering game. The wagering game can be played physically in a physical casino or electronically.

Description of the Related Art

Casino table games using cards (both played in live format and electronic format) are a billion dollar industry. The industry is also striving to produce new and exciting wagering methods which players may find fresh and exciting and the house (casino) finds profitable.

FIG. 1 is a flowchart illustrating a method of implementing the known game of blackjack.

Points totals are computed by adding the standard rank value of each card, with face valued cards (tens, jacks, queens, kings) being given a value of 10, and aces being given a value of 1 or 11, whichever results in a better hand. A soft point total is where at least one ace is given the value of 11. A hard point total is a hand with all aces counting as 1.

In operation 100, the player makes a main wager by placing chips on a table. Then, in operation 102, the dealer deals two initial cards (or "initial two cards") to each player (either face up or face down although the player would always have the opportunity to view his/her own face down initial two cards) and two initial cards to the dealer, typically one face down ("hole-card"), and one face up (the "up-card"). Then the player can decide whether to hit, stand, double, or split. If the player decides to hit, then the method proceeds to operation 106, which deals an additional card to a player. If a determination 108 determines that the player has busted (the player's hard point total is over 21), then the player loses the game and thus loses the main wager in operation 110, which ends the game. If the determination 108 determines that the player has not busted, then the method returns to operation 104, where the player can make another decision whether to hit or stand. In operation 104, the player can also double (not pictured) by place an additional wager of up to the main wager, but the player is limited to drawing only one additional card before the player must stand.

If the player stands and has not busted out (either stands on his or her initial two cards or draws cards but has a point total under 22 and then stands), then the method proceeds to operation 112, which reveals all dealer's cards (e.g., turns the hole-card face up) and which then plays out the dealer's hand according to predetermined rules. In operation 114, if the dealer's total is greater than a predetermined amount (typically 17), then the dealer stands (proceeds to operation 122). If the dealer's total is not greater than the predetermined amount, the method proceeds to operation 116 which deals an additional card to the dealer. If it is then determined

118 that the dealer has not busted (has a point total over 21), the method returns to operation 114. If the dealer has busted, then the player wins the game and the main wager in operation 120 (this assumes the player has not also busted; if the player has already busted then the player would have lost in operation 110).

In operation 122, both the player and the dealer have played out their hand and neither have busted. Thus, their respective point totals (adding the numerical values of each card in the hand) are compared. If the dealer's point total is determined in operation 124 to be lower than the player's point total, then the player wins the game and the main wager in operation 120. Otherwise, if the dealer's point total is determined 128 to be greater than the player's point total, then the player loses the game and the main wager in operation 130. If the player's point total ties the dealer's point total, then that results in a "push" in operation 126 in which the player doesn't win or lose the main wager (the main wager is a wash).

If a player is initially dealt two identically ranked cards in operation 102 (e.g., two 2's, two 10-valued cards, etc.), players can also split in operation 104 by placing an additional split wager equal in value to the main wager, and the player's two initial cards are separated and the dealer deals an additional card on each. The player then plays out each of the two separate hands, each from operation 104 as separate hands. Depending on house rules, players may or may not be allowed to resplit cards.

Furthermore, a 'push 22' rule is known in the art (see U.S. Pat. No. 7,435,172) which sets forth that when the dealer busts on a point total of 22 (or other total), the player's main wager would push (instead of winning as a standard game).

SUMMARY OF THE INVENTION

It is an aspect of the present invention to provide an exciting casino system.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
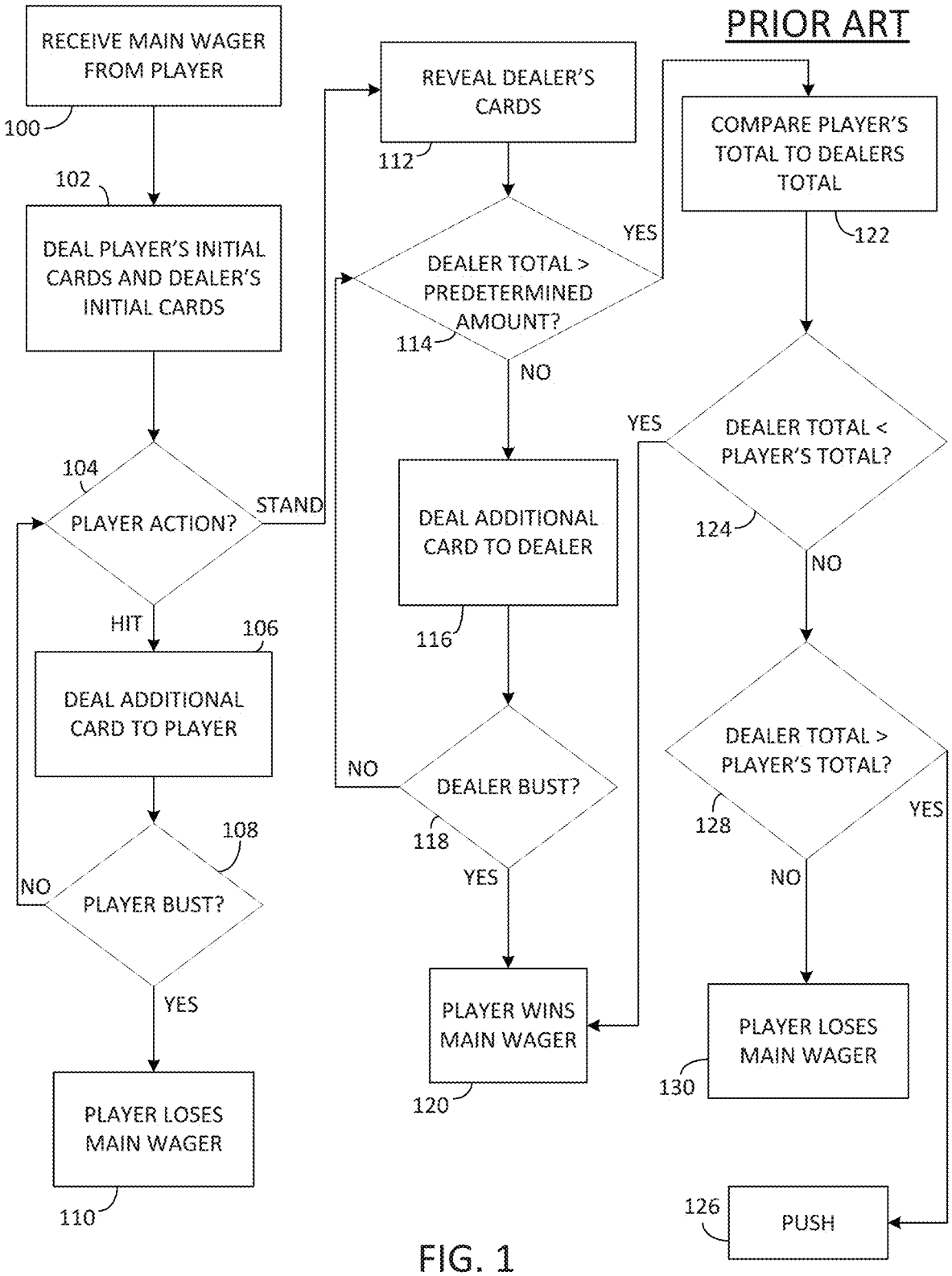
FIG. 1 is a flowchart illustrating a method of implementing a prior art blackjack game, according to an embodiment.

Reference will now be made in detail to the presently preferred embodiments of the invention, examples of which are illustrated in the accompanying drawings, wherein like reference numerals refer to like elements throughout.

The general inventive concept relates to a side wager (also known as side bet) in which a number of cards in a particular hand which are of a particular suit are counted, and the side wager is paid based on a number of that suit. The particular suit the side wager is based on is known before the game is played. For example, the suit can be one of: diamonds, clubs, spades, hearts. For example, consider that the side wager is based upon diamonds, and a player wagers $1 on the side wager and is dealt a five card hand which only includes the following cards: 5-hearts/2-diamonds/9-spades/king-diamonds/ace-diamonds. The player's hand has three cards with the suit of diamonds. The payout is then determined using a paytable specially designed for that particular game (utilizing parameters such as the number of cards in the hand, desired house edge for the side wager, etc.) So for example, this particular diamond based side wager might be as follows: 0 diamond cards=−1 (loss), 1 diamond card=1:1 (even money), 2:1 diamond cards=2, 3 diamond cards=3:1, 4 or more diamond cards=5:1. This is just one example payout to illustrate the operation of the method but it can be appreciated that many other such paytables can be utilized. According to this paytable, since the player has received three diamond cards, then his/her payout would be 3:1 or $1 (meaning the player is paid $3 plus can keep his/her original $1 wager). Thus, in this side wager, the player would be rooting for his/her hand to include as many cards with the specific suit that the side wager is based upon. Note that since there are an equal number of suited cards in a standard deck (e.g., a standard deck has 13 diamonds, 13 spades, 13 clubs, and 13 hearts), then a paytable with one suit as the specific suit should work equally well for any other suit being the specific suit.

The inventive concept can be applied to numerous games which utilize cards, such as blackjack, baccarat, poker (either player versus player or player versus dealer), etc. The cards utilized for the side wager will be known (e.g., the player's hand, dealer's hand, or some other set of cards used in the game play) so that when the cards are dealt only these cards are utilized to determine how many cards of the specific suit there are.

The game of blackjack is described in U.S. patent publication 2003/0155715 which is incorporated by reference herein in their entireties. The game can be played with any number (e.g., 1-8) of standard 52 card decks (either physical deck(s) played on a physical table in a brick and mortar casino, or virtual deck(s) used for an electronic version).

FIG. 1 is a flowchart illustrating a method of implementing the known game of blackjack.

In general, casino blackjack is played by one or more players at a gaming table against a dealer using one or more decks of cards (each deck can be a standard 52 card deck). The idea is for the player to make a point total closest to 21 without going over 21 (busting). Each player (after making a main wager) is dealt two initial cards (typically face up) and the dealer is also dealt two cards (one face up—the upcard, and one face down—the hole card). The player can stand on his or her initial two cards, or continuously hit (take another card) until the player stands or the player's point total is over 21 (upon which the player automatically loses). If the player has not busted, then after the player stands the dealer will play out the dealer's hand according to predetermined rules. One set of dealer predetermined rules is as follows: the dealer will continuously hit until the dealer's point total is greater than 16. Once the dealer has resolved the dealer's hand, the wager is resolved. If the player has busted then the player loses (the main wager). If the player has not busted but the dealer has busted (the dealer's point total is over 21) then the player wins (wins even money on the main wager). If both the player and the dealer have not busted, then if the player's point total is higher than the dealer's point total then the player wins (wins even money on the main wager). If both the player and the dealer have no busted, then if the dealer's point total is higher than the player's point total then the dealer wins (the player loses the main wager). If the player's point total equals the dealer's point total, then the main wager pushes (neither wins nor loses). Other options the player may have at his or her disposal is to double down or split. Cards are given their standard numerical value (i.e., aces count as 1 or 11 (whichever makes the best hand), 2's-10's count as their respective face value, jacks, queens, and kings all count as 10).

The inventive concept described herein can be applied to the game of blackjack. For example, the dealer's hand (i.e., all cards in the dealer's hand only) can be used to determine how many cards of the specific suit are present. The number of cards in the dealer's hand can vary depending on whether the dealer has to draw, and if the dealer draws, how many draw cards the dealer draws. The blackjack side wager can be configured so that it would only pay when the dealer busts otherwise the side wager would lose.

Figure 2A:
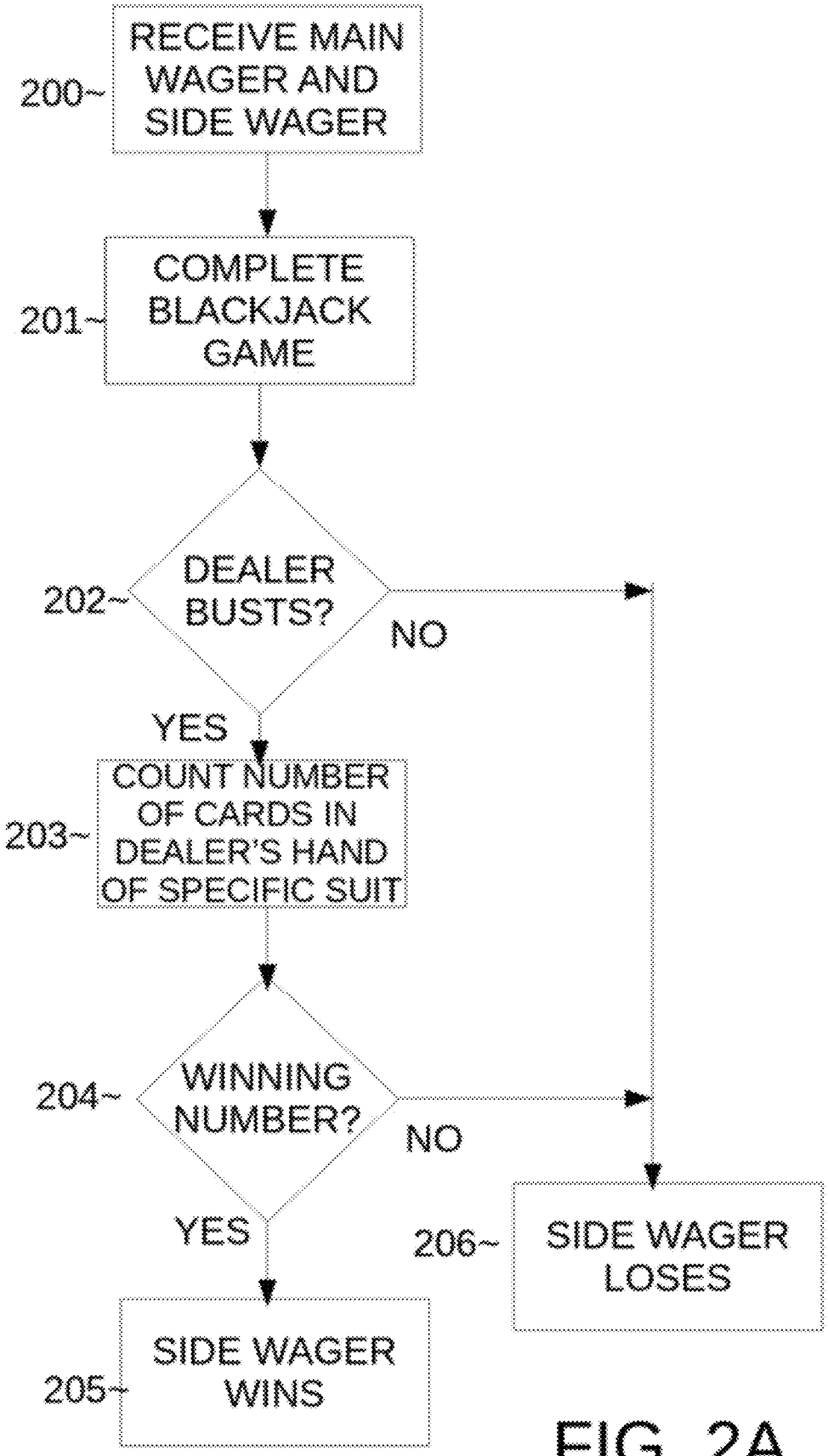
FIG. 2A is a flowchart illustrating a method of implementing a blackjack side wager utilizing counts of a particular suit, according to an embodiment.

FIG. 2A is a flowchart illustrating a method of implementing a blackjack side wager utilizing counts of a particular suit, according to an embodiment.

In operation 200, the player makes a wager (in the form of chips in the physical table version) or in the form of credits in the online/electronic version. The main wager must be made while the side wager is optional.

From operation 200, the method proceeds to operation 201, which completes the blackjack, game. This can be done as shown/described in operations 102 to 130.

From operation 201, the method proceeds to operation 202, which determines whether the dealer busts (busted during the game). The dealer busts if the dealers hard (meaning aces count as 1) point total is greater than 21. If the dealer has not busted, then the method proceeds to operation 206, in which the side wager loses (and is collected from the player).

In operation 202, if the dealer has busted, then the method proceeds to operation 203 which counts the number of cards in the dealer's hand which are of the specific suit. For example, if the specific suit is hearts then the number of cards in the dealer's hand that are hearts would be counted. If in operation 202, the dealer has not busted then the method proceeds to operation 205 wherein the side wager loses (is taken by the casino/house/game).

From operation 203, the method proceeds to operation 204, which determines whether the number of cards in the dealer's hand (which busted) that are the specific suit (determined in operation 203) is a winning number (which is determined using a paytable for the side wager). If the number of cards in the dealer's hand of the specific (predetermined) suit do not qualify for a payout (is not a winner) then the method proceeds to operation 206, wherein the side wager loses.

If in operation 204, the number of cards in the dealer's hand (which busted) are a winning number (typically greater than a predetermined number) then the method proceeds to operation 205, wherein the side wager wins and is paid a payout based on the paytable (typically a multiple of the side wager placed in operation 200). Whether the side wager wins is irrespective of whether the main wager wins or loses (although typically the player would be more likely to win their main wager if the dealer busts as opposed to the dealer making a hand).

Note that some example paytables for blackjack are shown in the attached Appendix labeled "Diamond Bust Card Paytable."

Note that the inventive concept described herein of counting cards of a specific predetermined suit in a reference hand and basing a payout based on the number of such cards can be applied to any card game. For example, it can be applied to baccarat, and the reference hand can be either the player's hand or the dealer's (banker's) hand. In an embodiment, two separate side wagers can be offered, one using the player's hand as the reference hand and one using the dealer's hand as the reference hand.

Figure 2B:
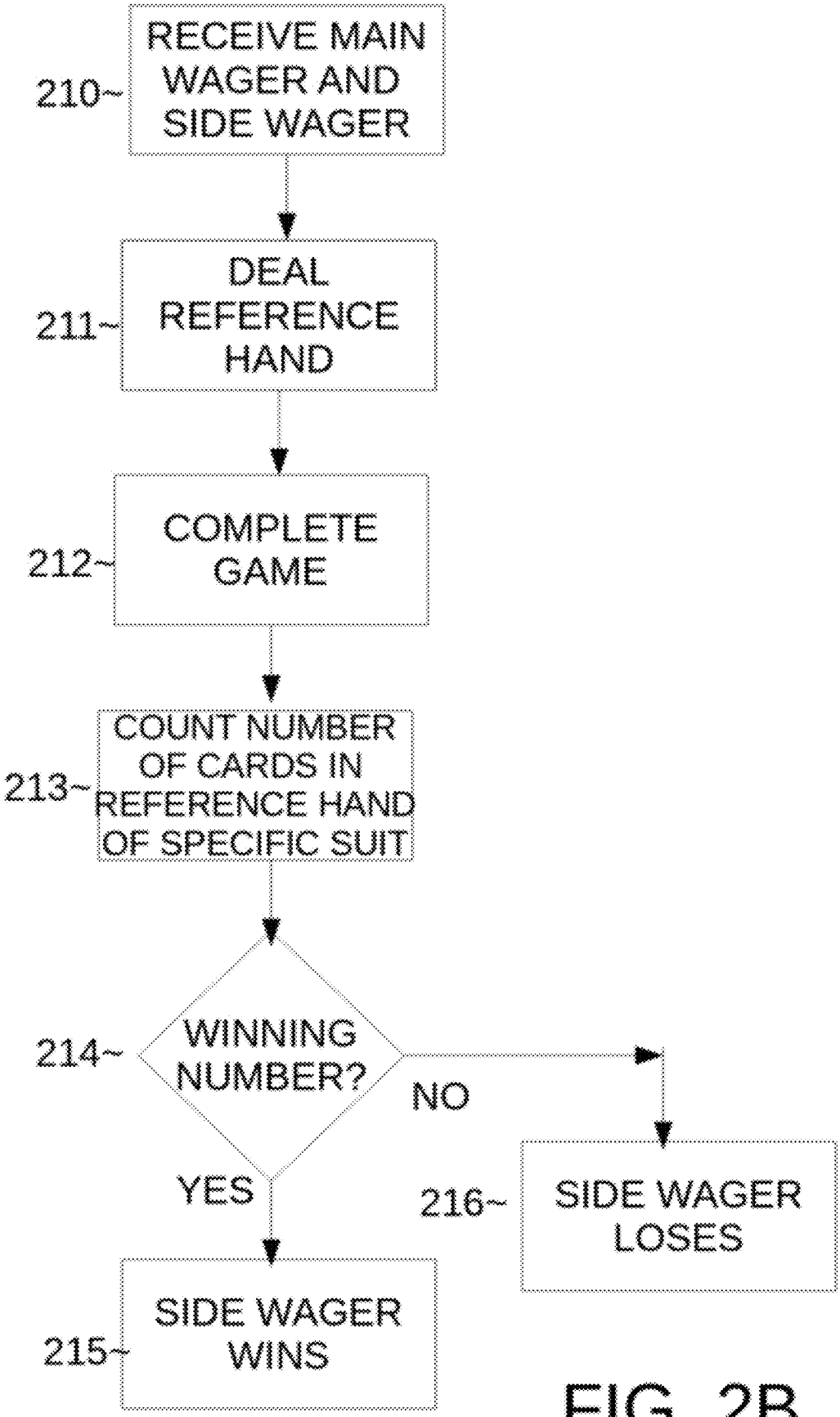
FIG. 2B is a flowchart applying a method of wagering based on counting cards of a specific suit to any type of card game, according to an embodiment.

FIG. 2B is a flowchart applying a method of wagering based on counting cards of a specific suit to any type of card game, according to an embodiment.

In operation 210, the house (or casino software in the electronic version) receives a main wager on the game and an optional side wager. This can be done as described herein and as known in the art (e.g., placing physical chips (redeemable for cash) on a physical casino table, or betting virtual chips on an electronic device).

From operation 210, the method proceeds to operation 211, which deals a reference hand. This can be dealt all at once or in parts (e.g., one card to reference hand, next card to another hand, next card to the reference hand, etc.) Ultimately, the reference hand will be fully dealt and this is the hand which is utilized to determine what the payout on the side wager (synonymous with side bet) is.

From operation 211, the method proceeds to operation 212, which completes the game. The outcome of the game has no direct affect on the resolution of the side wager.

From operation 212, the method proceeds to operation 213, which counts the number of cards in the reference hand that are of the specific (predetermined suit). For example, if the predetermines suit is spades, then all cards in the reference hand that are spades are counted. The range of such cards can be from zero to the number of cards in the reference hand.

From operation 213, the method proceeds to operation 214, which determines whether the number of cards in the reference hand with the specific suit (determined in operation 213) is high enough to be a winner for the side wager (e.g., in an example paytable, there must be at least two cards of the specific suit to get a payout on the side wager otherwise the side wager loses). Any payout at all on the side wager would be considered a winner.

If in operation 214, the player does not have enough cards of the specific suit in the reference hand to qualify as a winner, the method proceeds to operation 216, wherein the side wager loses.

If in operation 215, the player does have enough cards of the specific suit in the reference hand to qualify as a winner, the method proceeds to operation 215, wherein the side wager wins and wins a predetermined payout (multiple of the side wager) based on a number of the cards of the specific suit are in the reference hand. Typically, the more such cards the player has, the higher the payout on the side wager. The winning payout is determined using a paytable. For example, if the payout for a particular number of cards of the specific suit in the reference hand is 3:1, this means that if the player bet $2 on the side wager then the payout would be $6 (the side wager multiplied by the respective payout on the paytable) plus the player gets to keep his/her original side wager.

Note that the method illustrated and described with respect to FIG. 2B can be applied to any table game, and any set of cards could be used as the reference hand. For example, a game known as ULTIMATE TEXAS HOLDEM deals two player cards to each player, two dealer cards to the dealer, and five community cards. Thus, each player can make the side bet and the reference hand would consist of these nine cards (the two player's cards, the two dealer's cards, and the five community cards). Each player would have a different reference hand because each player would be dealt their own respective two card player hand (although the other seven cards in each player's reference hand would remain the same). Of course, the paytable being used would have to reflect the number of cards in the reference hand. In this case, the paytable should be designed for nine cards in the reference to ensure the expected value of the paytable is in an optimal range (e.g., 85% to 95% of the side wager), and of course the expected value of the paytable cannot exceed 100%. The inventive concept can be applied to any other such poker game as well.

Figure 3:
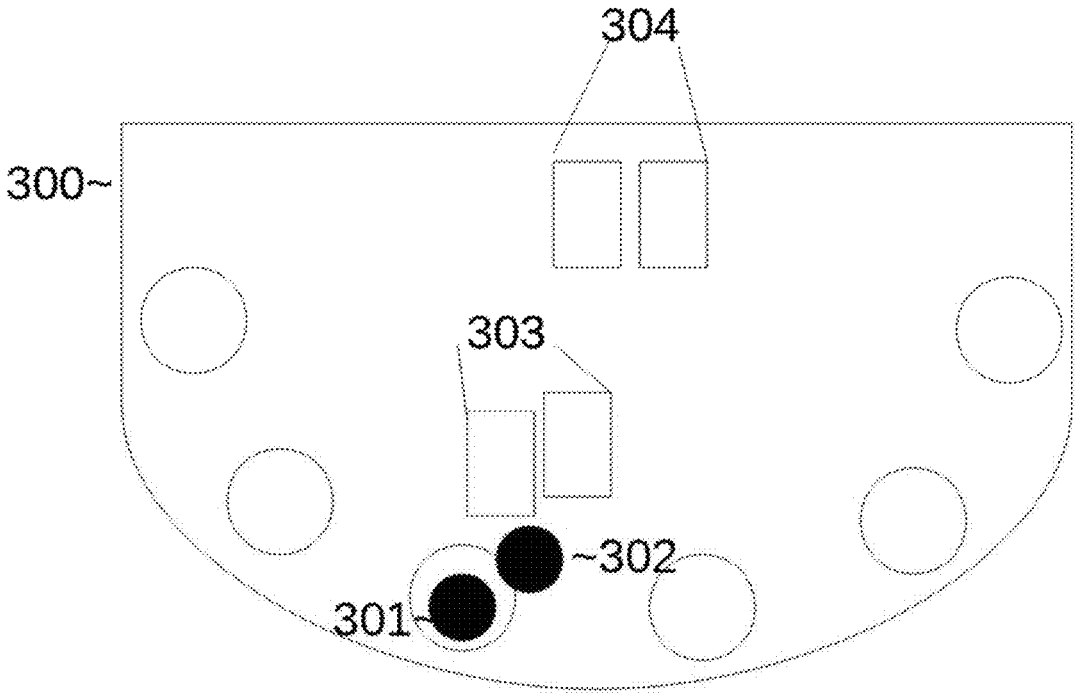
FIG. 3 is a drawing of a physical blackjack table for use in a casino, according to an embodiment.

FIG. 3 is a drawing of a physical casino game table for use in a casino, according to an embodiment. This can be a physical table with physical cards and physical chips, or it can also be a virtual display on an electronic computer display which utilizes computer animation to display the progress of the game.

The table 300 has six betting circles which can accommodate six simultaneous players (although other numbers of players can be accommodated as well). A dealer's hand 304 and a player's hand 303 are dealt. A player makes a wager 301 and a side wager 302 in the form of chip(s).

Figure 4A:
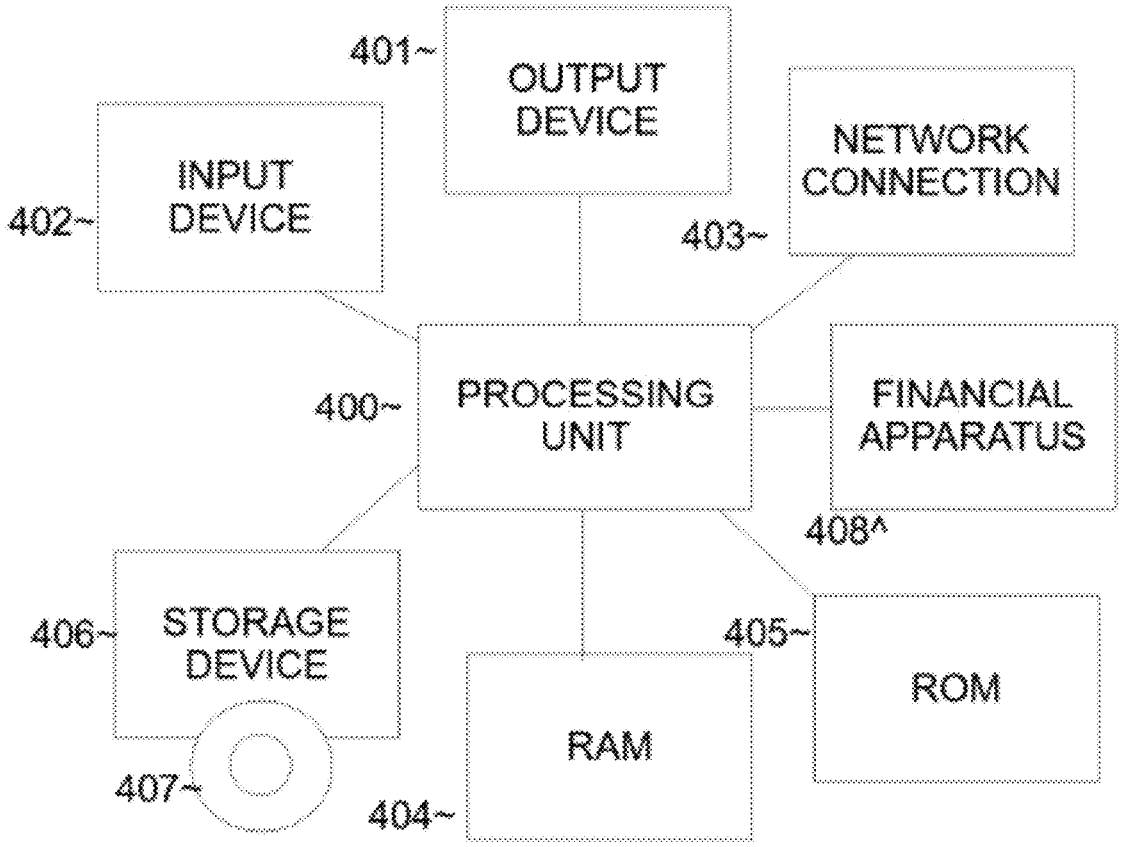
FIG. 4A is a block diagram illustrating exemplary hardware that can be used to implement an electronic version of the methods described herein.

FIG. 4A is a block diagram illustrating hardware that can be used to implement electronic versions of the wagering methods described herein, according to an embodiment. The hardware can be, for example, an electronic gaming machine (EGM) used in casinos. The hardware can also be a personal computer, playing the game using the Internet at an Internet casino for real money. The hardware can also be a digital casino table, for example the kind described in U.S. Pat. No. 7,775,887, which is incorporated by reference herein in its entirety. The hardware can also be any computing device, such as a cellular phone, tablet, etc., and the methods described herein can be installed as software (e.g., an app) on the device. The hardware can also be any other type of device, working individually or in conjunction with other devices. The hardware can also be a digital poker table, of the kind described in U.S. Pat. No. 7,758,411 which is incorporated by reference herein in its entirety.

A processing unit 400 (such as a microprocessor and any associated components) is connected to an output device 401 (such as an LCD monitor, touch screen, CRT, etc.) which is used to display to the player any aspect of the method, and an input device 402 (e.g., buttons, a touch screen, a keyboard, mouse, etc.) which can be used to input from the player any decision made by the player. All methods described herein can be performed by the processing unit 400 by loading and executing respective instructions. The processing unit 400 can also be connected to a network connection 403, which can connect the electronic gaming device to a computer communications network such as the Internet, a LAN, WAN, etc. The processing unit 400 is also connected to a RAM 404 and a ROM 405. The processing unit 400 is also connected to a storage device 406 which can be a DVD-drive, CD-ROM, flash memory, etc. Multiple such processing units can also work in collaboration with each other (in a same or different physical location). A non-transitory computer readable storage medium 407 can store a program which can control the electronic device to perform any of the methods described herein and can be read by the storage device 406. The processing unit 400 can also be connected to a financial apparatus 408 which can receive cash and convert the received cash into playable credits for use by the player when playing the electronic device. When the player decides to cash out any remaining credits, the financial apparatus 408 can issue coins or a cashless ticket (voucher) for the remaining credits which is redeemable by the player.

While one processing unit is shown, it can be appreciated that one or more such processor can work together (either in a same physical location or in different locations) to combine to implement any of the methods described herein. Programs and/or data required to implement any of the methods/features described herein can all be stored on any non-transitory computer readable storage medium (volatile or non-volatile, such as CD-ROM, RAM, ROM, EPROM, microprocessor cache, etc.)

Figure 4B:
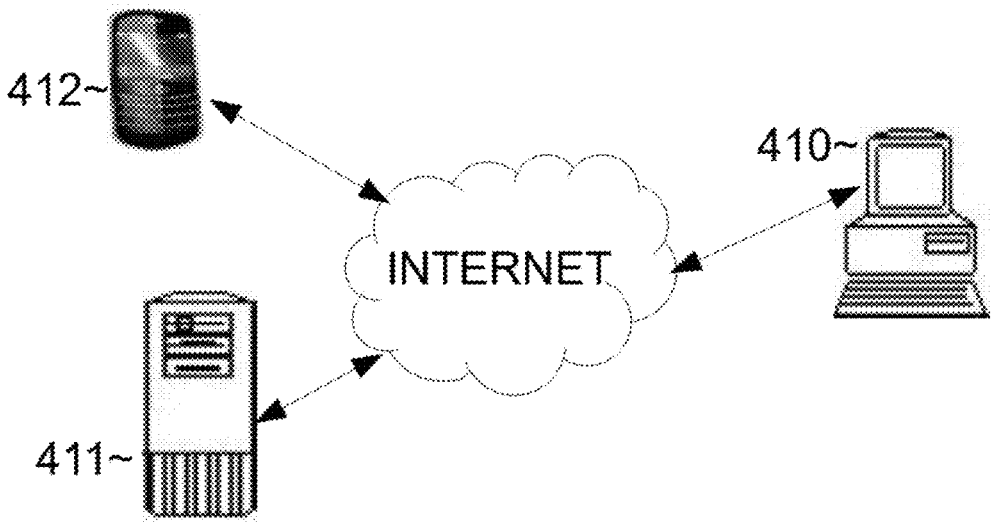
FIG. 4B is a block diagram illustrating an exemplary network configuration to implement a player playing an online version of the methods described herein.

FIG. 4B is a block diagram illustrating an exemplary network configuration to implement a player playing an online version of the methods described herein. All the methods described herein can be implemented on an online casino for real money (credits which are purchased for cash and are redeemable for cash) or for non-cash value credits. A player uses a personal computer 410 (e.g., cell phone, tablet, PC, etc.) can connect to a server 411 (which can have the structure illustrated in FIG. 4A) using a computer communications network such as the Internet. The server 411 hosts an online casino which determines the outcomes of the game and serves the outcomes to the computer 410 so the computer 410 displays the outcomes to the player. Other users can also play at the online casino hosted by the server 411 simultaneously, such as using a cell phone 412 with wireless internet connectivity. Any number of players (e.g., 1 to 100 or more than 100) can be connected to the internet and can play simultaneously on the sever 411 even though these players are all located in different physical locations. The general structure of online casinos is well known in the art.

It is noted that the methods described herein can be played with any number of standard decks of 52 cards (e.g., 1 deck to 10 decks). A standard deck is a collection of cards comprising an Ace, two, three, four, five, six, seven, eight, nine, ten, jack, queen, king, for each of four suits (comprising spades, diamonds, clubs, hearts) totaling 52 cards. Cards can be shuffled or a continuous shuffling machine (CSM) can be used. A standard deck of 52 cards can be used, as well as other kinds of decks, such as Spanish decks, decks with wild cards, etc. The operations described herein can be performed in any sensible order. Furthermore, numerous different variants of house rules can be applied.

Note that in the embodiments played using computers (a processor/processing unit), "virtual deck(s)" of cards are used instead of physical decks. A virtual deck is an electronic data structure used to represent a physical deck of cards which uses electronic representations for each respective card in the deck. A virtual card is displayed on an electronic output device using computer graphics and is displayed to mimic a real life image of that card.

Methods described herein can also be played on a physical table using physical cards and physical chips used to place wagers. Such physical chips can be directly redeemable for cash. When a player wins (dealer loses) the player's wager, the dealer will pay that player a respective payout amount. When a player loses (dealer wins) the player's wager, the dealer will take (collect) that wager from the player and typically place those chips in the dealer's chip rack. All rules, embodiments, features, etc. of a game being played are typically communicated to the player (e.g., verbally or on a written rule card) before the game begins.

Initial cash deposits can be made into the electronic gaming machine which converts cash into electronic credits. Wagers can be placed in the form of electronic credits, which can be cashed out for real coins or a ticket (e.g., ticket-in-ticket-out) which can be redeemed at a casino cashier or kiosk for real cash and/or coins.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer. All variations and features described herein can be combined with any other features described herein without limitation. All features in all documents incorporated by reference herein can be combined with any feature(s) described herein, and also with all other features in all other documents incorporated by reference, without limitation.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

APPENDIX

Diamond Bust Card Paytable

Total Cards Dealt 6

| Total Diamonds | Hits | Probability | Pay | Contribution |
|---|---|---|---|---|
| 6 | 1716 | 8.4289E−05 | 200 | 0.016857807 |
| 5 | 50193 | 0.002465454 | 15 | 0.036981814 |
| 4 | 529815 | 0.026024239 | 5 | 0.130121197 |
| 3 | 2613754 | 0.128386248 | 1 | 0.128386248 |
| 2 | 6415578 | 0.315129882 | 0.5 | 0.157564941 |
| 1 | 7484841 | 0.367651529 | −1 | −0.367651529 |
| 0 | 3262623 | 0.160258359 | −1 | −0.160258359 |
| Total | 20358520 | 1.000000 | | −0.05799788 |

Total Cards Dealt 7

| Total Diamonds | Hits | Probability | Pay |
|---|---|---|---|
| 7 | 1716 | 1.28266E−05 | 500 |
| 6 | 66924 | 0.000500237 | 150 |

APPENDIX-continued

| Diamond Bust Card Paytable | | | |
|---|---|---|---|
| 5 | 953667 | 0.007128379 | 10 |
| 4 | 6534385 | 0.048842594 | 4 |
| 3 | 23523786 | 0.17583334 | 2 |
| 2 | 44909046 | 0.335681831 | −1 |
| 1 | 42414099 | 0.31703284 | −1 |
| 0 | 15380937 | 0.114967953 | −1 |
| Total | 133784560 | 1.000000 | |

What is claimed is:

1. A method for implementing a blackjack game, the method comprising:

providing a physical blackjack gaming table, the physical blackjack gaming table having thereon a discrete first wagering area corresponding to placement of a main wager, a discrete second wagering area corresponding to placement of a side wager on a reference hand, a discrete hand area corresponding to placement of the reference hand, and a discrete paytable area corresponding to a paytable, wherein each of the first wagering area, the second wagering area, the hand area, and the paytable area are different from each other and correspond to different areas of the physical blackjack gaming table;

providing at least one physical deck of cards, each card of the at least one physical deck of cards having at least a suit from a plurality of suits;

providing the paytable in the paytable area, the paytable including a plurality of numbers of cards of a specific suit and a respective payout for each number of cards of the specific suit from the plurality of numbers of cards of the specific suit; and using the physical blackjack gaming table, the at least one physical deck of cards, and the paytable to implement the blackjack game comprising:

receiving, from a player using first physical gaming chips having a first monetary value, a main wager in the first wagering area, and a side wager in the second wagering area;

dealing, into the hand area and from the at least one physical deck of cards, a plurality of cards corresponding to the reference hand;

determining a number of cards in the dealt reference hand that are of the specific suit;

providing predetermined side wager resolution rules which comprise:

(i) if the determined number of cards of the specific suit in the reference hand is at least a predetermined number, then the side wager wins and paying a payout on the side wager using the paytable based on the determined number of cards of the specific suit in the reference hand, wherein the payout comprises one or more second physical gaming chips having a second monetary value, and (ii) if the number of cards of the specific suit in the reference hand is not at least the predetermined number, then the side wager loses and collecting one or more of the first physical gaming chips corresponding to the side wager; and resolving the side wager according to the predetermined side wager resolution rules.

2. The method as recited in claim 1, wherein the specific suit is diamonds.

3. The method as recited in claim 1, wherein the reference hand is dealt to a dealer.

4. The method as recited in claim 3, wherein the predetermined side wager resolution rules include collecting the side wager in response to the dealer standing with the reference hand having a value of 21 or less.

5. The method as recited in claim 1, wherein the reference hand is dealt to the player.

6. The method as recited in claim 1, wherein the payout on the side wager is a function of the side wager amount.

7. The method as recited in claim 6, wherein the payout on the side wager according to the paytable increases as the number of cards of the specific suit in the reference hand increases.

8. The method as recited in claim 1 further comprising:

receiving a second side wager from the player using physical chips;

dealing a second reference hand different from the reference hand;

determining a number of cards in the second reference hand that are of the specific suit; and resolving the second side wager based on the predetermined side wager resolution rules and the second reference hand.

9. The method as recited in claim 1, wherein at least one processor monitors the reference hand, determines the number of cards in the reference hand that are of the specific suit, and resolves the side wager using the predetermined side wager resolution rules.

10. The method as recited in claim 1, wherein the reference hand includes at least an initial hand of two dealt cards from the at least one physical deck of cards and any subsequently dealt cards combined with the initial hand.

11. A gaming system for implementing a blackjack game, the system comprising:

a physical blackjack gaming table configured for play of the blackjack game using at least one physical deck of cards, the physical blackjack gaming table having thereon a discrete first wagering area corresponding to placement of a main wager, a discrete second wagering area corresponding to placement of a side wager on a reference hand, a discrete hand area corresponding to placement of the reference hand, and a discrete paytable area corresponding to a paytable, wherein each of the first wagering area, the second wagering area, the hand area and the paytable area are different from each other and correspond to different areas of the physical blackjack gaming table; wherein each card of the at least one physical deck of cards has at least a suit from a plurality of suits; and a paytable including a plurality of numbers of cards of a specific suit and a respective payout for each number of cards of the specific suit from the plurality of numbers of cards of the specific suit, wherein the payable is visibly presented in the paytable area of the physical blackjack gaming table;

wherein the blackjack game implemented using the physical blackjack gaming table, the at least one physical deck of cards, and the paytable include a method for resolving side wagers, the method comprising:

receiving, from a player using first physical gaming chips having a first monetary value, a main wager in the first wagering area and a side wager in the second wagering area;

dealing, into the hand area and from the at least one physical deck of cards, a plurality of cards corresponding to the reference hand from the at least one physical deck of cards;

determining a number of cards in the dealt reference hand that are of the specific suit;

providing predetermined side wager resolution rules which comprise:

(i) if the determined, number of cards of the specific suit in the reference hand is at least a predetermined number, then the side wager wins and paying a payout on the side wager using the paytable based on the determined number of cards of the specific suit in the reference hand, wherein the payout comprises one or more second physical gaming chips having a second monetary value, and (ii) if the number of cards of the specific suit in the reference hand is not at least the predetermined number, then the side wager loses and collecting one or more of the first physical gaming chips corresponding to the side wager; and resolving the side wager according to the predetermined side wager resolution rules.

12. The gaming system as recited in claim 11, wherein the specific suit is diamonds.

13. The gaming system as recited in claim 11, wherein the reference hand is dealt to a dealer.

14. The gaming system as recited in claim 13, wherein the predetermined side wager resolution rules include collecting the side wager in response to the dealer standing with the reference hand having a value of 21 or less.

15. The gaming system as recited in claim 11, wherein the reference hand is dealt to the player.

16. The gaming system as recited in claim 11, wherein the payout on the side wager is a function of the side wager amount.

17. The gaming system as recited in claim 11, wherein method of the blackjack game further comprises:

receiving a second side wager from the player using physical chips;

dealing a second reference hand different from the reference hand;

determining a number of cards in the second reference hand that are of the specific suit; and resolving the second side wager based on the predetermined side wager resolution rules and the second reference hand.

18. The gaming system as recited in claim 11 further comprising at least one processor configured to:

monitor the reference hand;

determine the number of cards in the reference hand that are of the specific suit; and resolve the side wager using the predetermined side wager resolution rules.

19. The gaming system as recited in claim 11, wherein the reference hand includes at least an initial hand of two dealt cards from the at least one physical deck of cards and any subsequently dealt cards combined with the initial hand.

* * * * *